US008794333B1

(12) United States Patent
Milanovich

(10) Patent No.: US 8,794,333 B1
(45) Date of Patent: Aug. 5, 2014

(54) COMBINATION BLOWOUT PREVENTER AND RECOVERY DEVICE

(71) Applicant: Philip John Milanovich, Phoenix, AZ (US)

(72) Inventor: Philip John Milanovich, Phoenix, AZ (US)

(73) Assignee: Milanovich Investments, L.L.C., Phoenix, AZ (US)

( * ) Notice: Subject to any disclaimer, the term of this patent is extended or adjusted under 35 U.S.C. 154(b) by 0 days.

(21) Appl. No.: 13/952,655

(22) Filed: Jul. 28, 2013

Related U.S. Application Data

(63) Continuation-in-part of application No. 13/933,128, filed on Jul. 2, 2013, now Pat. No. 8,651,189, and a continuation-in-part of application No. 13/947,084, filed on Jul. 21, 2013.

(51) Int. Cl.
*E21B 34/00* (2006.01)
*E21B 33/064* (2006.01)
*E21B 43/01* (2006.01)

(52) U.S. Cl.
CPC ..... *E21B 33/064* (2013.01); *E21B 43/0122* (2013.01)
USPC ..... 166/351; 166/335; 166/343; 166/361; 166/364; 166/379; 405/52

(58) Field of Classification Search
CPC ..... E21B 33/06; E21B 33/061; E21B 33/062; E21B 34/02
USPC ..... 166/335, 343, 344, 351, 364, 379; 405/52, 60
See application file for complete search history.

(56) References Cited

U.S. PATENT DOCUMENTS

| | | | | |
|---|---|---|---|---|
| 1,543,456 | A | 6/1925 | Stirling | |
| 3,548,848 | A | 12/1970 | Stichling | |
| 3,681,923 | A * | 8/1972 | Hyde | 405/60 |
| 3,745,773 | A * | 7/1973 | Cunningham | 405/60 |
| 3,766,979 | A * | 10/1973 | Petrick | 166/55 |
| 3,980,094 | A | 9/1976 | Schroeder et al. | |
| 3,980,138 | A | 9/1976 | Knopik | |
| 4,215,749 | A | 8/1980 | Dare et al. | |
| 4,220,207 | A | 9/1980 | Allen | |
| 4,301,827 | A | 11/1981 | Murthy et al. | |

(Continued)

FOREIGN PATENT DOCUMENTS

| | | |
|---|---|---|
| CA | 2 506 828 A1 | 10/2006 |
| GB | 2 175 328 A | 11/1986 |
| SU | 1427057 A1 | 9/1988 |

*Primary Examiner* — Jennifer H Gay
*Assistant Examiner* — Elizabeth Gitlin
(74) *Attorney, Agent, or Firm* — Swift & Swift; Stephen Christopher Swift

(57) ABSTRACT

A combination blowout preventer and recovery device, comprising a lower part that is placed over a well pipe, and an upper part having a channel and plates to close it. The large end of the valve is placed over a well pipe through which fluid is flowing out. The small end of the valve is connected to the channel. A sleeve connected to the return pipe is placed over the well pipe. Positioning rings are attached to a high pressure pipe, that can fit inside the well pipe. Grinders remove matter from the well pipe. Pistons are attached to each of the plates. The pistons propel the plates across the channel to seal it off and stop the leak. Flanges may limit the pistons' movement. Gears can engage teeth on the pistons to withdraw the plates from the channel, to reopen it and allow the flow of fluid to resume.

20 Claims, 20 Drawing Sheets

(56) References Cited

U.S. PATENT DOCUMENTS

| | | | | | |
|---|---|---|---|---|---|
| 4,323,117 | A | * | 4/1982 | Pierce | 166/55 |
| 4,376,467 | A | | 3/1983 | Allen | |
| 4,440,523 | A | | 4/1984 | Milgram et al. | |
| 4,456,071 | A | * | 6/1984 | Milgram | 166/356 |
| 4,523,639 | A | | 6/1985 | Howard, Jr. | |
| 4,531,860 | A | * | 7/1985 | Barnett | 405/60 |
| 4,568,220 | A | | 2/1986 | Hickey | |
| 4,605,069 | A | | 8/1986 | McClaflin et al. | |
| 4,619,284 | A | | 10/1986 | Delarue et al. | |
| 4,790,936 | A | * | 12/1988 | Renfrow | 210/242.3 |
| 4,969,676 | A | | 11/1990 | LaMagna | |
| 5,012,854 | A | | 5/1991 | Bond | |
| 5,064,164 | A | | 11/1991 | Le | |
| 5,156,212 | A | * | 10/1992 | Bryant | 166/298 |
| 5,199,496 | A | | 4/1993 | Redus et al. | |
| 5,213,444 | A | * | 5/1993 | Henning | 405/63 |
| 5,735,502 | A | | 4/1998 | Levett et al. | |
| 6,026,904 | A | | 2/2000 | Burd et al. | |
| 6,059,040 | A | | 5/2000 | Levitan et al. | |
| 6,119,779 | A | | 9/2000 | Gipson et al. | |
| 6,125,928 | A | * | 10/2000 | Ninivaara et al. | 166/55 |
| 6,244,560 | B1 | * | 6/2001 | Johnson | 251/1.3 |
| 6,354,568 | B1 | | 3/2002 | Carruthers | |
| 6,601,888 | B2 | | 8/2003 | McIlwraith et al. | |
| 6,739,570 | B2 | | 5/2004 | Carlsen | |
| 7,243,713 | B2 | | 7/2007 | Isaacks et al. | |
| 7,814,979 | B2 | * | 10/2010 | Springett et al. | 166/298 |
| 7,987,903 | B1 | | 8/2011 | Prado Garcia | |
| 8,016,030 | B1 | | 9/2011 | Prado Garcia | |
| 8,205,678 | B1 | | 6/2012 | Milanovich | |
| 8,316,872 | B1 | | 11/2012 | Milanovich | |
| 8,418,767 | B1 | | 4/2013 | Milanovich | |
| 8,434,558 | B2 | * | 5/2013 | Swanson et al. | 166/368 |
| 8,555,979 | B1 | * | 10/2013 | Milanovich | 166/354 |
| 2009/0050828 | A1 | | 2/2009 | Edwards | |
| 2010/0171331 | A1 | | 7/2010 | Jonas et al. | |
| 2013/0206421 | A1 | * | 8/2013 | De Ghetto et al. | 166/357 |

* cited by examiner

COMBINATION BLOWOUT PREVENTER AND RECOVERY DEVICE

CROSS REFERENCE TO RELATED APPLICATION

This application is a Continuation-In-Part of Regular Utility patent application Ser. No. 13/933,128, filed Jul. 2, 2013, and a Continuation-In-Part of Regular Utility patent application Ser. No. 13/947,084, filed Jul. 21, 2013, both of which are incorporated herein by reference.

BACKGROUND OF THE INVENTION

1. Field of the Invention

The present invention relates to apparatus and methods for preventing, stopping and/or controlling the escape of oil, gas or other fluid from wells or pipes.

2. Description of the Prior Art

As shown by recent events in the Gulf of Mexico, oil well blowouts are a serious threat to the environment, and can be very costly. There is a need for reliable devices for recovering from blowouts. None of the prior inventions discussed below are equivalent to the present invention.

U.S. Pat. No. 1,543,456 issued on Jun. 23, 1925, to Robert Stirling, discloses a blowout preventer, without the explosive charges and pistons or the Bernoulli effect of the instant invention.

U.S. Pat. No. 3,548,848, issued on Dec. 22, 1970, to Gerhardt C. Stichling, discloses explosively actuated valves, but does not disclose their use in a blowout control device, as in the instant invention.

U.S. Pat. No. 3,766,979, issued on Oct. 23, 1973, to John T. Petrick, discloses a well casing cutter and sealer, but does not disclose pistons moving the plates, as in the instant invention.

U.S. Pat. No. 3,980,094, issued on Sep. 14, 1976, to Fritz Schröder and Klaus Rössel, discloses a quick action slide valve with a sliding plate, but does not disclose the pistons moving the plates of the instant invention.

U.S. Pat. No. 3,980,138, issued on Sep. 14, 1976, to Duane L. Knopik, discloses an underground fluid recovery device, but does not disclose a funnel that is placed over a pipe from which fluid is escaping, as in the instant invention.

U.S. Pat. No. 4,215,749, issued on Aug. 5, 1980, to Roy R. Dare and Jeff L. Merten, discloses a gate valve for shearing workover lines to permit shutting a well, using a shear plate and pistons. The instant invention is distinguishable, in that in it the plates are explosively activated and/or retractable by gears.

U.S. Pat. No. 4,220,207, issued on Sep. 2, 1980, to Neil W. Allen, discloses a sea floor diverter, without the use of the Bernoulli effect, as in the instant invention.

U.S. Pat. No. 4,301,827, issued on Nov. 24, 1981, to Rajam R. Murthy and Billy J. Rice, discloses a guided-float accumulator suitable for use with a hydraulic system for an oil well blowout preventer, using reaction forces that oppose Bernoulli effect forces, rather than making use of Bernoulli effect forces as in the instant invention.

U.S. Pat. No. 4,376,467, issued on Mar. 15, 1983, to Neil W. Allen, discloses a sea floor diverter, without the use of the Bernoulli effect, as in the instant invention.

U.S. Pat. No. 4,440,523, issued on Apr. 3, 1984, to Jerome H. Milgram and James Burgess, discloses a separating collector for subsea blowouts, but without air or other fluid being pumped down to create a Bernoulli effect, as in the instant invention.

U.S. Pat. No. 4,523,639, issued on Jun. 18, 1985, to Roland M. Howard, Jr., discloses ram-type blowout preventers, with a piston and a locking mechanism to hold the plate in the channel after the pipe has been cut, but does not disclose a flange to limit motion of the piston, as in the instant invention.

U.S. Pat. No. 4,558,220, issued on Feb. 4, 1986, to John J. Hickey, discloses a system for capping and/or controlling undersea oil or gas well blowouts, but without the use of the Bernoulli effect, as in the instant invention.

U.S. Pat. No. 4,605,069, issued on Aug. 12, 1986, to McClafin et al., discloses a method for producing heavy, viscous crude oil, but it is not a blowout recovery device, as is the instant invention.

U.S. Pat. No. 4,619,284, issued on Oct. 28, 1986, to Jean-Jacques Delarue and Claude Ego, discloses a pyrotechnic valve that may either close an initially open pipe or open an initially closed pipe, but does not disclose its use in a blowout control device, as in the instant invention.

U.S. Pat. No. 4,969,676, issued on Nov. 13, 1990, to Joseph L. LaMagna, discloses an air pressure pick-up tool using the Bernoulli effect, but it is not a blowout recovery device, as is the instant invention.

U.S. Pat. No. 5,012,854, issued on May 7, 1991, to John A. Bond, discloses a pressure release valve for a subsea blowout preventer that is hydraulically operated, without making use of the Bernoulli effect, nor disclosing that the plates are explosively activated and/or retractable by gears, as in the instant invention.

U.S. Pat. No. 5,064,164, issued on Nov. 12, 1991, to Tri C. Le, discloses a blowout preventer with metal inserts resembling the plates in the instant invention, but does not disclose explosive actuation or movement of the plates by gears, as in the instant invention.

U.S. Pat. No. 5,156,212, issued on Oct. 20, 1992, to Thomas B. Bryant, discloses a method and system for controlling high pressure flow, such as in containment of oil and gas well fires, but does not disclose pistons whose movement is limited by flanges, as in the instant invention.

U.S. Pat. No. 5,199,496, issued on Apr. 6, 1993, to Clifford L. Redus and Peter L. Sigwardt, discloses a subsea pumping device incorporating a wellhead aspirator, using the Bernoulli effect, but does not disclose a funnel placed over a pipe from which fluid is escaping, as in the instant invention.

U.S. Pat. No. 5,735,502, issued on Apr. 7, 1998, to Bryce A. Levett and Mike C. Nicholson, discloses a blowout preventer with ram blocks resembling the plates in the instant invention, and is hydraulically actuated. The instant invention is distinguishable in that it has pistons whose movement is limited by flanges.

U.S. Pat. No. 6,026,904, issued on Feb. 22, 2000, to James A. Burd and Kenneth J. Huber, discloses a method and apparatus for commingling and producing fluids from multiple production reservoirs, but it is not a blowout recovery device, as is the instant invention.

U.S. Pat. No. 6,059,040, issued on May 9, 2000, to Leonid L. Levitan, Vasily V. Salygin and Vladimir D. Yurchenko, discloses a method and apparatus for the withdrawal of liquid from wellbores, but unlike the instant invention, it is not a blowout recovery device.

U.S. Pat. No. 6,119,779, issued on Sep. 19, 2000, to Larry Joe Gipson and Stephen Leon Carn, discloses a method and system for separating and disposing of solids from produced fluids, but unlike the instant invention, it is not a blowout recovery device.

U.S. Pat. No. 6,354,568, issued on Mar. 12, 2002, to Alec Carruthers, discloses a sliding plate valve, but does not disclose pistons whose movement is limited by flanges, as in the instant invention.

U.S. Pat. No. 6,601,888, issued on Aug. 5, 2003, to Lon McIlwraith and Andrew Christie, discloses contactless handling of objects, using the Bernoulli effect, but unlike the instant invention, it is not a blowout preventer.

U.S. Pat. No. 6,739,570, issued on May 25, 2004, to Hans-Paul Carlsen, discloses a valve element, which may be used for closing a channel in a blowout preventer, but does not disclose pistons whose movement is limited by flanges, as in the instant invention.

U.S. Pat. No. 7,243,713, issued on Jul. 17, 2007, to C. Steven Isaacks, discloses a shear/seal assembly for a ram-type blowout prevention system. The instant invention is distinguishable, in that it discloses plates that are explosively activated and/or retractable by gears.

U.S. Pat. No. 7,987,903, issued on Aug. 2, 2011, to Jose Jorge Prado Garcia, discloses an apparatus and method for containing oil from a deep water oil well, but does not disclose the use of the Bernoulli effect, as in the instant invention.

U.S. Pat. No. 8,016,030, issued on Sep. 13, 2011, to Jose Jorge Prado Garcia, discloses an apparatus and method for containing oil from a deep water oil well, but does not disclose the use of the Bernoulli effect, as in the instant invention.

U.S. Patent Application Publication No. 2009/0050828, published on Feb. 26, 2009, to Jeffrey Charles Edwards, discloses blowout preventers with a housing having a throughbore resembling the channel in the instant invention, which may be closed by a pair of opposed rams, but does not disclose limitation of movement by flanges, explosive actuation, or movement by gears, as in the instant invention.

U.S. Patent Application Publication No. 2010/0171331, published on Jul. 8, 2010, to Stefan Jonas and Lutz Redmann, discloses a Bernoulli gripper for holding two-dimensional components such as silicon-based wafers, but it is not a blowout recovery device, as is the instant invention.

U.S. Pat. No. 8,205,678, issued on Jun. 26, 2012, U.S. Pat. No. 8,418,767, issued on Apr. 16, 2013, and pending U.S. patent application Ser. No. 13/837,065, filed on Mar. 15, 2013, all to Philip John Milanovich, the inventor and applicant herein, all disclose a blowout preventer with a Bernoulli Effect Suck-Down Valve. The instant invention is distinguishable, in that it includes a sleeve that is placed over the open end of the well pipe, and positioning rings attached to the high pressure pipe.

U.S. Pat. No. 8,316,872, issued on Nov. 27, 2012, and pending U.S. patent application Ser. No. 13/685,957, filed on Nov. 27, 2012, both to Philip John Milanovich, the inventor and applicant herein, disclose blowout preventers using plates propelled by explosive charges. The instant invention is distinguishable, in that in it the plates are moved by pistons, whose movement is limited by flanges.

British Patent No. 2 175 328, published on Nov. 26, 1986, to Richard Theodore Mitchell, discloses an oil well drilling apparatus, including a blowout preventer stack, without the use of explosive charges, or movement of the plates by pistons moved by gears, as in the instant invention.

Canadian Patent No. 2 506 828, published on Oct. 29, 2006, inventors Dean Foote and Scott Delbridge, discloses a blowout preventer with rams that are hydraulically rather than explosively actuated, or moved by pistons moved by gears, as in the instant invention.

Soviet Patent No. 1427057, published Sep. 30, 1988, inventors Y. U. A. Gavrilin, L. M. Torsunov and B. V. Venedictov, discloses a blowout preventer with a flat blocking gate.

None of the above inventions and patents, taken either singly or in combination, is seen to describe the instant invention as claimed.

SUMMARY OF THE INVENTION

The present invention is a combined blowout preventer and recovery device, having an upper part and a lower part. The lower part includes a large frustoconical funnel or valve, made of metal or other suitable material. The large end of the funnel is placed over a well pipe through which oil (or natural gas or other fluid) is flowing out. The small end of the valve is connected to a return pipe. A high pressure (air separating) pipe with a smaller diameter is inserted into the well pipe. Air is pumped under high pressure through the high pressure pipe, separating the oil and forcing the oil that is not kept down in the well pipe by the pressure up through the return pipe. A sleeve is suitably dimensioned and configured to be placed over a portion of the well pipe adjacent to the open end of the well pipe, with the sleeve being connected to the return pipe. A locking collar is attached to the sleeve. Cylindrical positioning rings are attached to the high pressure pipe, can fit inside the well pipe, and may have different diameters, heights and shapes, to help position the valve, funnel and sleeve onto the well pipe. A sharp edge extends from the sleeve, by which irregularities in the well pipe can be cut. Lasers or other cutting devices attached to extension arms, that can also cut irregularities in the well pipe. Grinders can remove cement or other material from the Well pipe. The slope of the funnel can be changed. The funnel and/or valve can be removed and raised to the surface with the aid of floats.

The upper part includes one or more blocks (made of metal, concrete or other suitable material), having a cylindrical channel. The return pipe is connected to the channel in the blocks. The oil (or other fluid) will initially flow through the channel. Alongside the channel are one or more circular plates, having diameters somewhat larger than the diameter of the channel. One or more pistons are attached to each of the plates. Explosive charges, or other means of movement, move the pistons, which move the plates. There is a passage in the blocks for each of the pistons, the passage having a narrow portion adjacent to the channel and a wide portion away from the channel. A flange on each piston, on an end of the piston opposite the plate to which it is attached, prevents the end of the piston from moving into the narrow portion of the passage, thus limiting the movement of the plate to which the piston is attached. There may be a plurality of pistons attached to each plate, and varying lengths of the pistons, and/or of the narrow and wide portions of the passages, can cause the plates to move varying distances. Gears having teeth can engage teeth on the pistons to move the plates out from the channel after the explosive charge has been fired. The plates may be moved out from the channel part way or all the way. The gears may also be an alternative means for moving the plates into the channel, either part way or all the way.

Accordingly, it is a first object of the invention to provide a blowout preventer and recovery device, that combines ease of attachment to a well pipe in its lower part, with means for securely shutting off or controlling flow in its upper part.

It is a second object of the invention to prevent damage to the environment from oil well blowouts.

It is a third object of the invention to prevent economic loss from oil well blowouts.

It is a fourth object of the invention to prevent damage to the environment from any kind of fluid escaping from a pipe.

It is a fifth object of the invention is to prevent economic loss from any kind of fluid escaping from a pipe.

It is a sixth object of the invention to create a safer environment for any fluid carrying pipe or pipe-like structure.

It is a seventh object of the invention to provide a control or shutoff mechanism that can be reopened.

It is an eighth object of the invention to provide a control or shutoff mechanism that can be repeatedly opened and shut.

It is a ninth object of the invention to provide an apparatus and method that is compatible with other blowout preventers and recovery devices.

It is a tenth object of the invention to provide a blowout preventer and recovery device that is manageable in size, weight and configuration.

It is an eleventh object of the invention to provide a blowout preventer and recovery device that can be sized appropriately to its need and usage.

It is a twelfth object of the invention to provide a blowout preventer and recovery device that can be used initially or retrofitted.

It is a thirteenth object of the invention to provide a blowout preventer and recovery device that has an immediate response time, thus saving lives and investment.

It is a fourteenth object of the invention to provide a blowout preventer and recovery device that has a shorter activation time than the prior art.

It is a fifteenth object of the invention to provide a blowout preventer and recovery device using plates, wherein if some plates are defective, they can be drilled through, and it will still be effective because of a multiple plate design.

It is a sixteenth object of the invention to provide a blowout preventer and recovery device, wherein stacking of plates gives multiple options for control.

It is a seventeenth object of the invention to provide a blowout preventer and recovery device that is easy to install or replace.

It is a seventeenth object of the invention to provide a means for fitting oil or gas wells with flow regulators to control and/or resume the flow of oil or gas.

It is an eighteenth object of the invention to provide a blowout preventer and recovery device that has moving parts.

It is a nineteenth object of the invention to provide a blowout preventer and recovery device that is removable and recoverable.

It is a twentieth object of the invention to provide a blowout preventer and recovery device with a removable and recoverable funnel.

It is a twenty-first object of the invention to provide a blowout preventer and recovery device that does not leave the well site.

It is a twenty-second object of the invention to provide a blowout preventer and recovery device that is usable in deep water, in shallow water, and on land.

It is a twenty-third object of the invention to provide a blowout preventer and recovery device that is safer to use than existing blowout recovery devices.

It is an twenty-fourth object of the invention to provide a blowout preventer and recovery device that is more controllable.

It is a twenty-fifth object of the invention to provide a blowout preventer and recovery device that is movable in all directions in three dimensions.

It is a twenty-sixth object of the invention to provide a blowout preventer and recovery device that is more environmentally friendly and limits the environmental impact of blowouts.

It is an twenty-seventh object of the invention to provide a blowout preventer and recovery device with a lock-on collar.

It is a twenty-eighth object of the invention to provide a blowout preventer and recovery device with a collar that is adjustable and removable.

It is a twenty-ninth object of the invention to provide a blowout preventer and recovery device with considerably less mass and weight.

It is a thirtieth object of the invention to provide a blowout preventer and recovery device with considerably less height and width.

It is a thirty-first object of the invention to provide a blowout preventer and recovery device that is easy to ship and handle.

It is a thirty-second object of the invention to provide a blowout preventer and recovery device that is reusable.

It is a thirty-third object of the invention to align the funnel and valve using cylindrical positioning rings.

It is an thirty-fourth object of the invention to provide a blowout preventer and recovery device that limits liability.

It is a thirty-fifth object of the invention to provide a blowout recovery valve that is more cost effective.

It is a thirty-sixth object of the invention to provide a blowout preventer and recovery device having a funnel with a floatation system that can cause it to float to the surface of a body of water.

It is a thirty-seventh object of the invention to provide a blowout preventer and recovery device having a funnel that can be flattened out.

It is a thirty-eighth object of the invention to provide a blowout preventer and recovery device with a jointed and seamed funnel.

It is an object of the invention to provide improved elements and arrangements thereof in an apparatus for the purposes described which is relatively inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a blowout preventer and recovery device, that may be used with well pipes from which oil, gas or other fluid is flowing, under a body of water or on land. It combines a lower part that is attached to the well pipe, and an upper part that shuts off or limits the flow.

Figure 1:
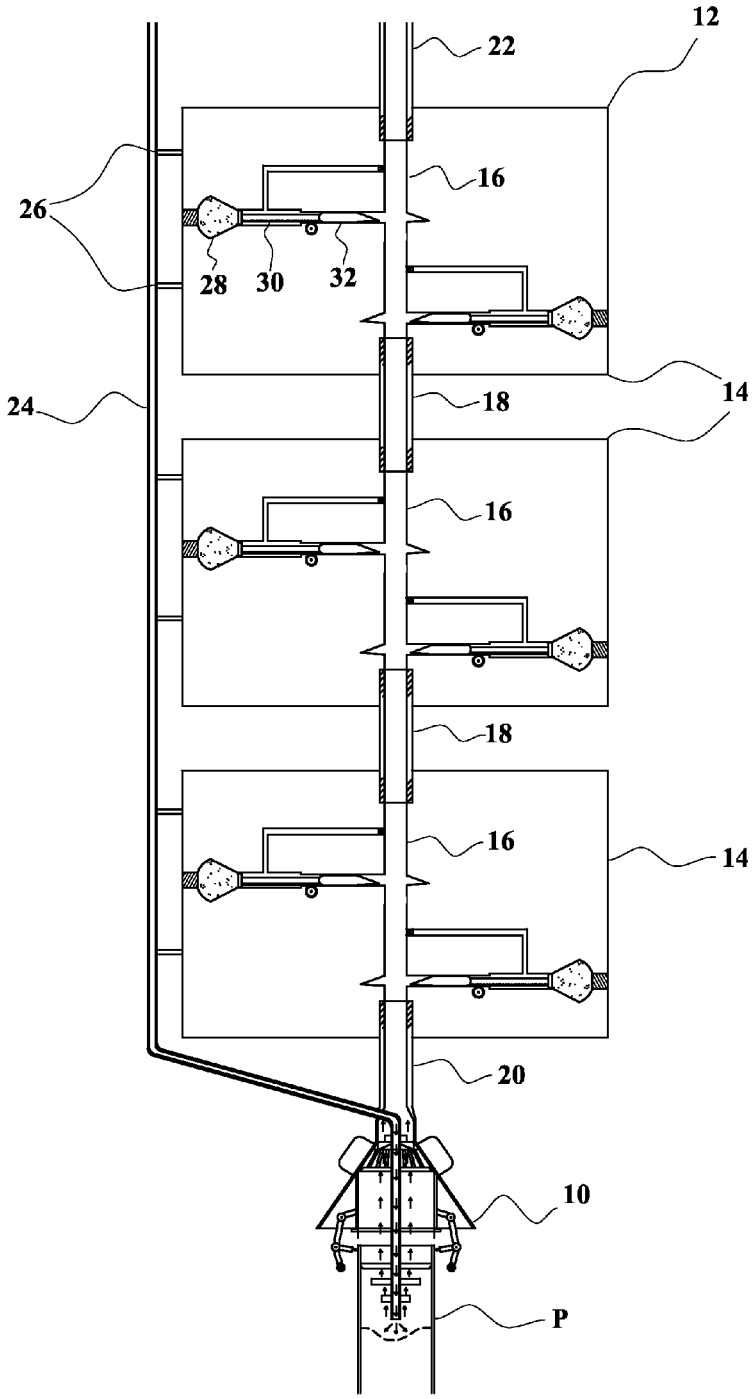
FIG. 1 is a vertical sectional view of the preferred embodiment of the invention.

FIG. 1 is a vertical sectional view of the preferred embodiment of the invention, showing the lower part 10 of the invention as it is about to be lowered onto a well pipe. The upper part 12 of the invention comprises blocks 14 with channels 16 that are connected by middle return pipes 18. A lower return pipe 20 connects the lower part of the invention to the channel in the lowest block in the upper part of the invention. An upper return pipe 22 extends from the channel in the highest block. A high pressure pipe 24 extends alongside the block, through the lower return pipe into the lower part of the invention. The high pressure pipe is retained by braces 26 a suitable distance from the explosive charges 28 that propel the pistons 30 that propel the plates 32 across the channels. Any number of the blocks may be stacked in a "Christmas tree". The blocks may be directly attached without middle pipes. There may be no upper pipe. Alternatively, a well pipe may pass through the channel, in which case the plate must be capable of cutting through it.

Figure 2:
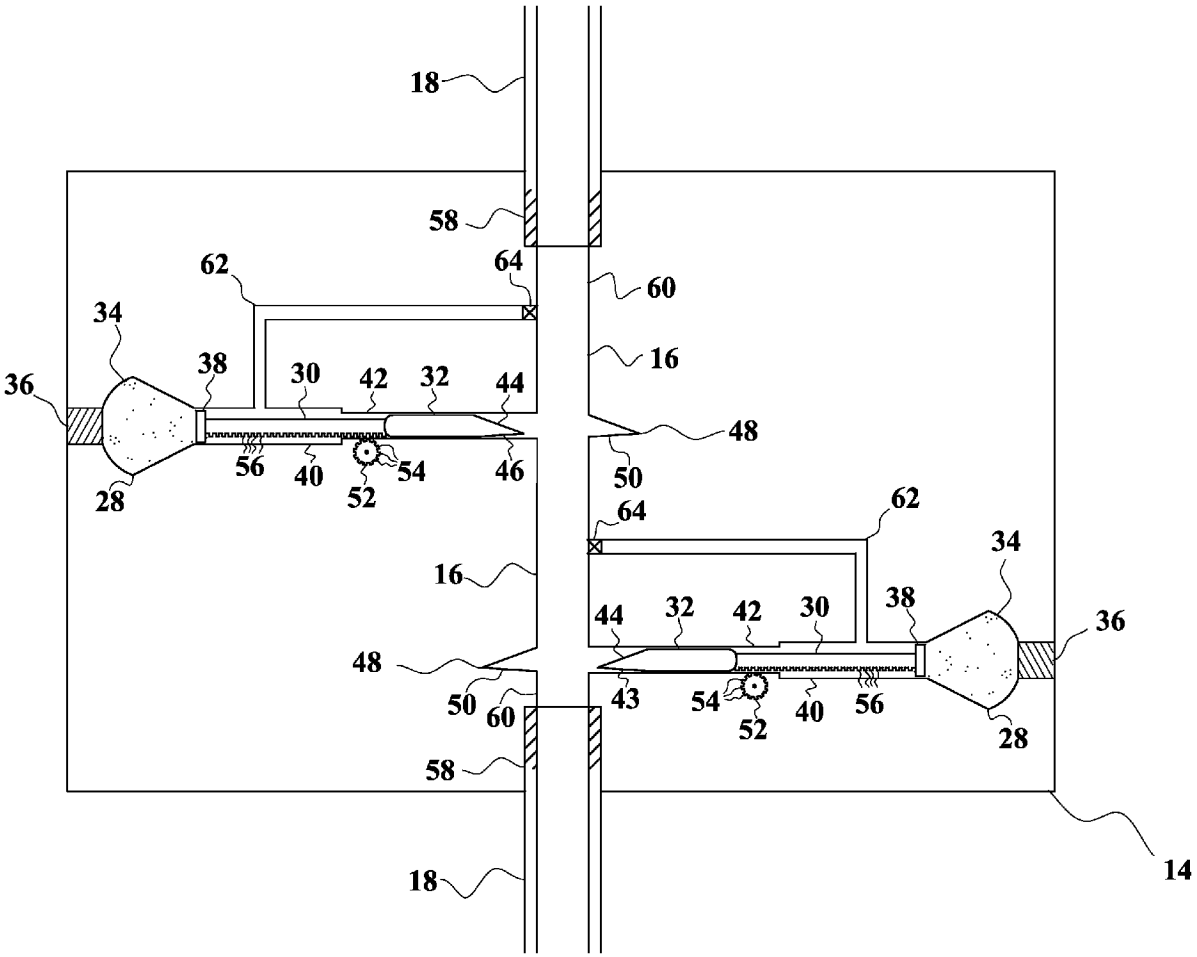
FIG. 2 is a vertical sectional detail view of a block having two plates in the preferred embodiment of the invention.

FIG. 2 is a vertical sectional detail view of a block 14 having two plates 32 in the preferred embodiment of the invention. The two plates will enter the channel 16 from different directions when the explosive charges 28 are fired. Blocks may also have three or more plates. Plates may enter the channel from any number of different directions.

Figure 3:
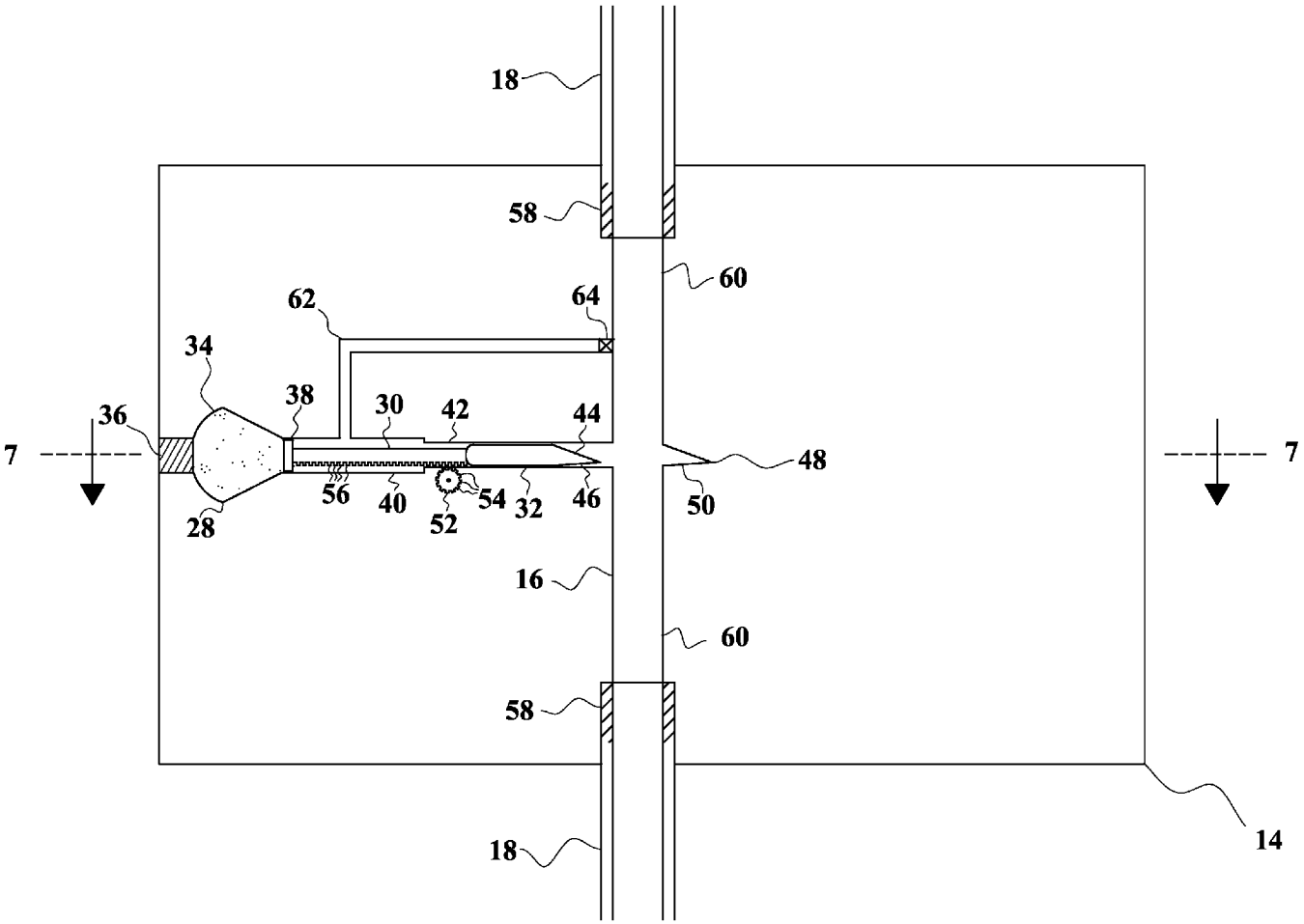
FIG. 3 is a vertical sectional detail view, along lines 3-3 in FIG. 7, of a block having one plate in the preferred embodiment of the invention, before the explosive charge is fired.
Figure 7:
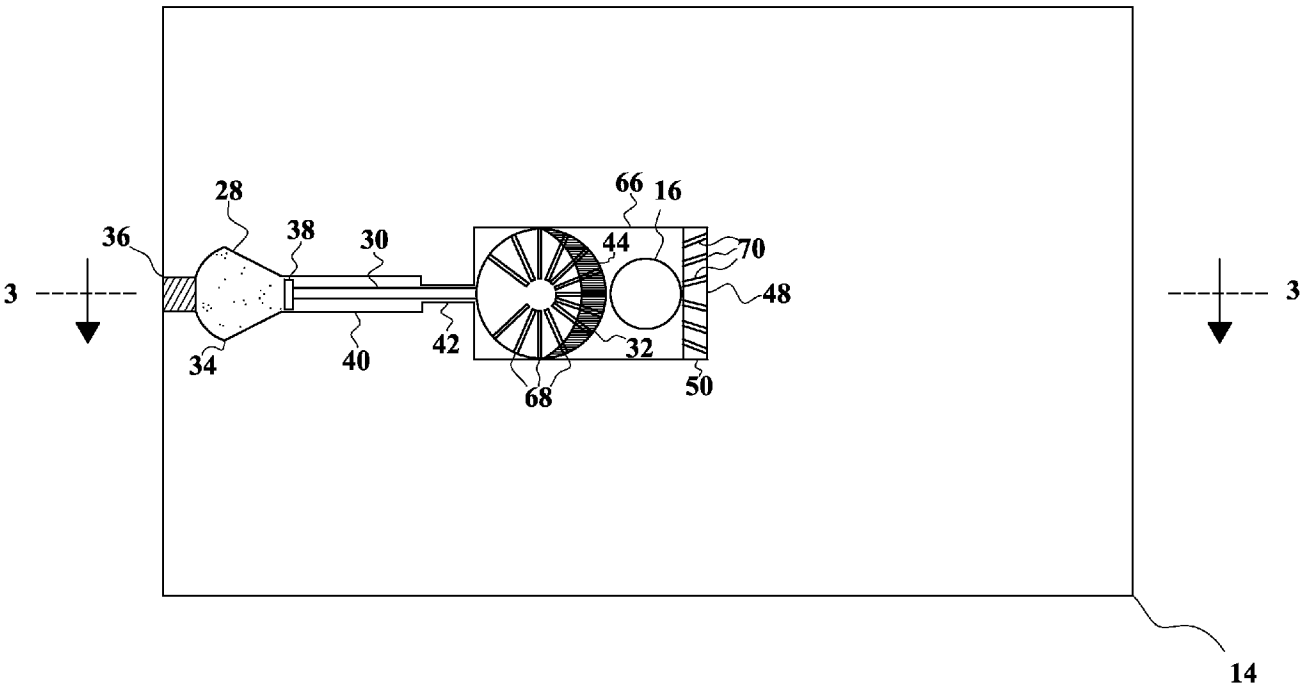
FIG. 7 is a horizontal sectional detail view, along lines 7-7 in FIG. 3, of a block having one plate in the preferred embodiment of the invention, before the explosive charge is fired.

FIG. 3 is a vertical sectional detail view, along lines 3-3 in FIG. 7, of a block having one plate in the preferred embodiment of the invention, showing the position of the plate 32 before the explosive charge 28 in the chamber 34 has been fired by the receiver/ignitor 36. The receiver/ignitor may be activated by radio waves, laser, sound, electricity, or any other suitable means. The piston 30 ends in a flange 38, and is attached to the plate 12 at its opposite end. The piston is propelled by the explosive charge and propels the plate. (Alternatively, the piston and plate may be propelled by hydraulic, pneumatic, mechanical or electrical means, or by any other suitable means.) The piston and plate move in a passage having a wider portion 40 and a narrower portion 42. The flange prevents the end of the piston from moving into the narrow portion of the passage, thus limiting the movement of the plate to which the piston is attached. Two or more pistons may be attached to each plate. The distance that pistons move the plates may be varied by the length of the pistons and/or the lengths of the wider and narrower portions of the passages. When there is more than one piston attached to a plate, the other pistons and their charges may serve as backups if a charge fails. (The movement of the plate may also be limited by the upper front edge 44 and lower front edge 46 engaging the female element 48, with sloping lower edge 50, on the opposite side of the channel 16.)

The gear 52 has teeth 54 that can engage teeth 56 on the underside of the piston, to move the plate completely or partially out from the channel 16. (The gear may also be used as an alternative to the explosive charge, to move the plate completely or partially into the channel. Alternatively, the plates can be drilled through to reopen the channel.) The block 14 is connected to middle return pipes 18. Oil, gas or other fluid can flow though channel 16. There may be screw threads 58 on the pipes near ends 60 of the channel. Gases produced when the explosive charge is ignited can pass through vent 62 and one-way valve 64 into the channel.

Figure 4:
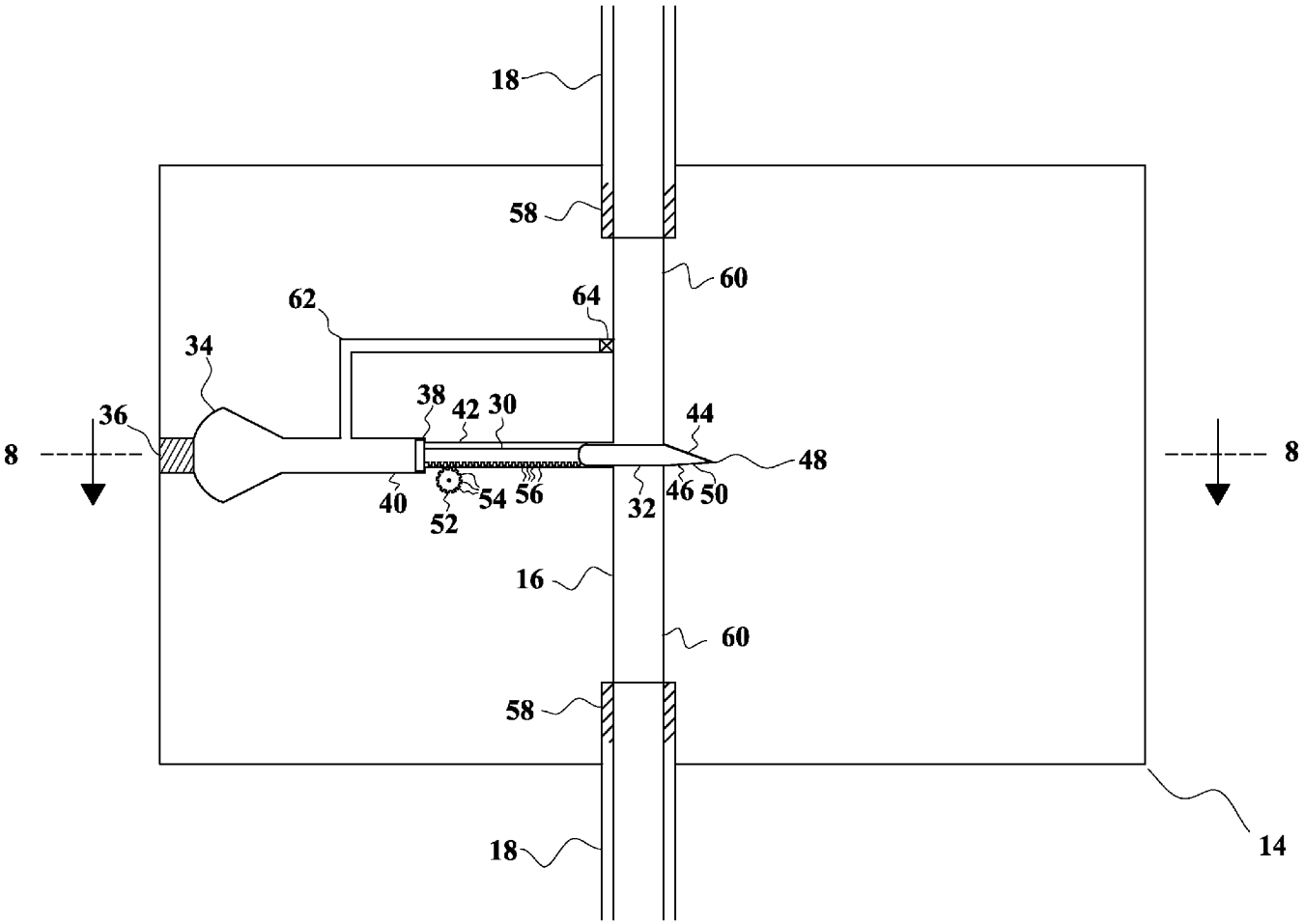
FIG. 4 is a vertical sectional detail view, along lines 4-4 in FIG. 8, of a block having one plate in the preferred embodiment of the invention, after the explosive charge has been fired.
Figure 5:
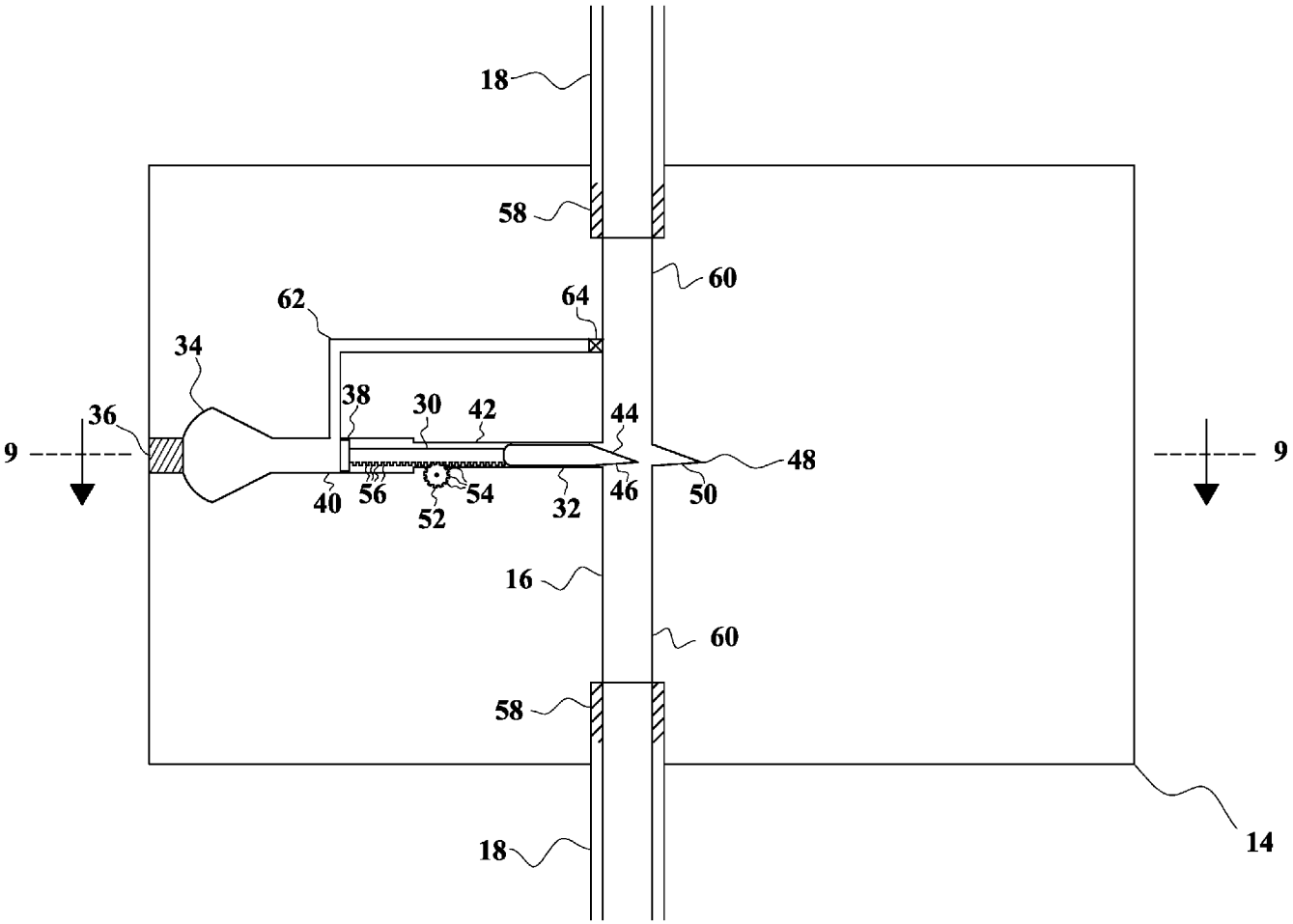
FIG. 5 is a vertical sectional detail view, along lines 5-5 in FIG. 9, of a block having one plate in the preferred embodiment of the invention, showing the plate covering two-thirds of the channel.
Figure 6:
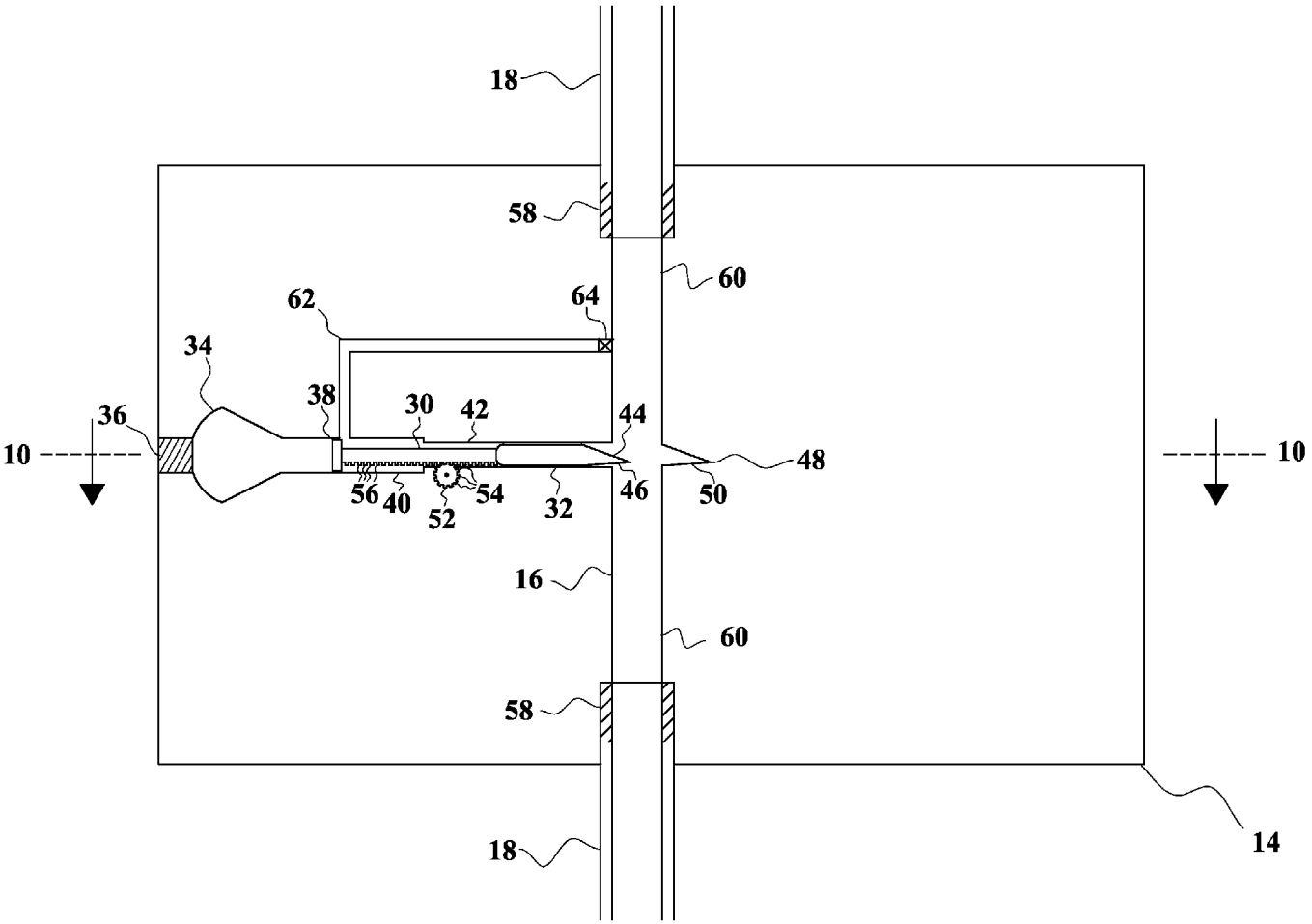
FIG. 6 is a vertical sectional detail view, along lines 6-6 in FIG. 10, of a block having one plate in the preferred embodiment of the invention, showing the plate covering one-third of the channel.
Figure 8:
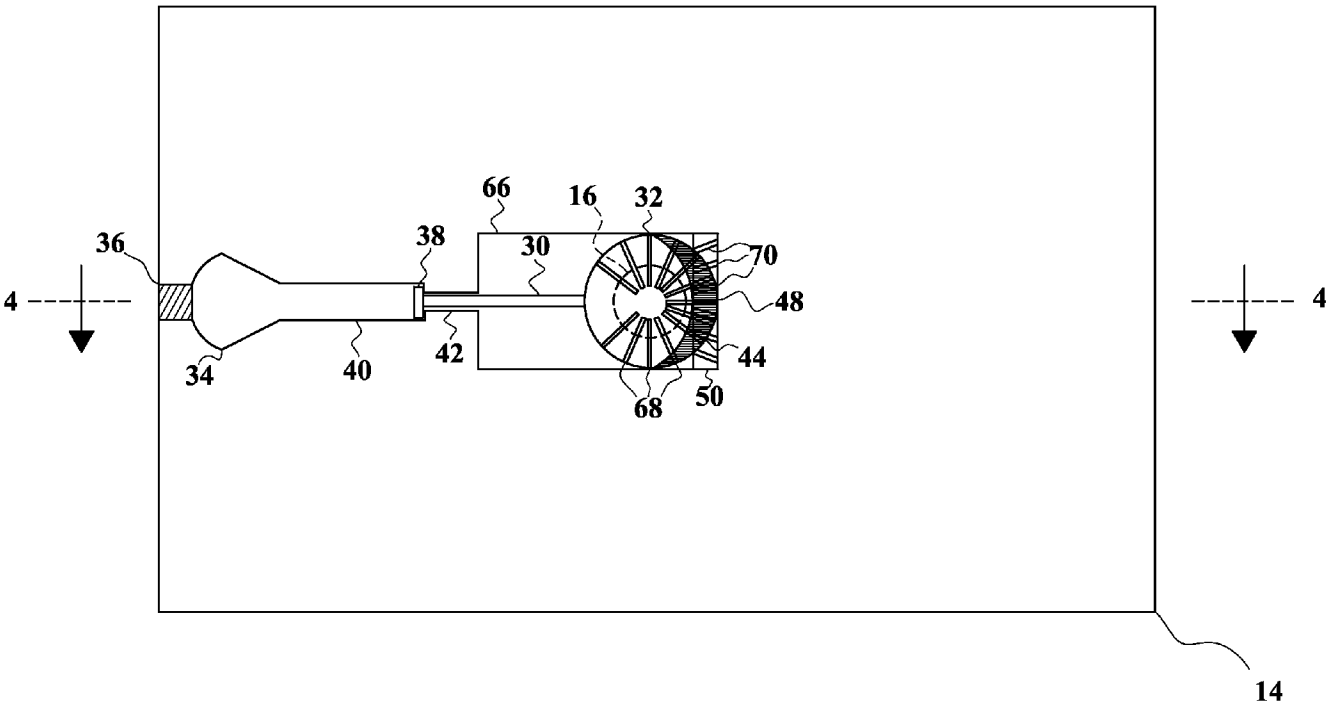
FIG. 8 is a horizontal sectional detail view, along lines 8-8 in FIG. 4, of a block having one plate in the preferred embodiment of the invention, after the explosive charge has been fired.

FIG. 4 is a vertical sectional detail view, along lines 4-4 in FIG. 8, of a block having one plate in the preferred embodiment of the invention, showing the position of the plate after the explosive charge for the piston has been fired, in which it is completely blocking the channel to prevent any fluid from passing through it. FIG. 5 is a vertical sectional detail view, along lines 5-5 in FIG. 9, of a block having one plate in the preferred embodiment of the invention, showing the position of the plate after it has been retracted to cover two-thirds of the channel, thus reducing and regulating the flow of oil or other fluid, but not completely blocking it. FIG. 6 is a vertical sectional detail view, along lines 6-6 in FIG. 10, of a block having one plate in the preferred embodiment of the invention, showing the position of the plate after it has been retracted to cover one-third of the channel, allowing greater flow, but still reducing it. The gear may be rotated by a motor or other suitable means. The gear may be lowered so as not to impede the movement of the piston and plate when the explosive charge is fired, and raised to mesh with the teeth in the piston.

FIG. 7 is a horizontal sectional detail view, along lines 7-7 in FIG. 3, of a block having one plate in the preferred embodiment of the invention, showing the position of the plate before any explosive charge has been fired. The portion of the passage 66 in which the plate moves may be wider horizontally, even it is the same height vertically as the portion of the narrower passage 42 in which only the piston moves. Grooves 68 in the plate and grooves 70 in the female element allow fluid to escape so that it does not impede the movement of the plate.

Figure 9:
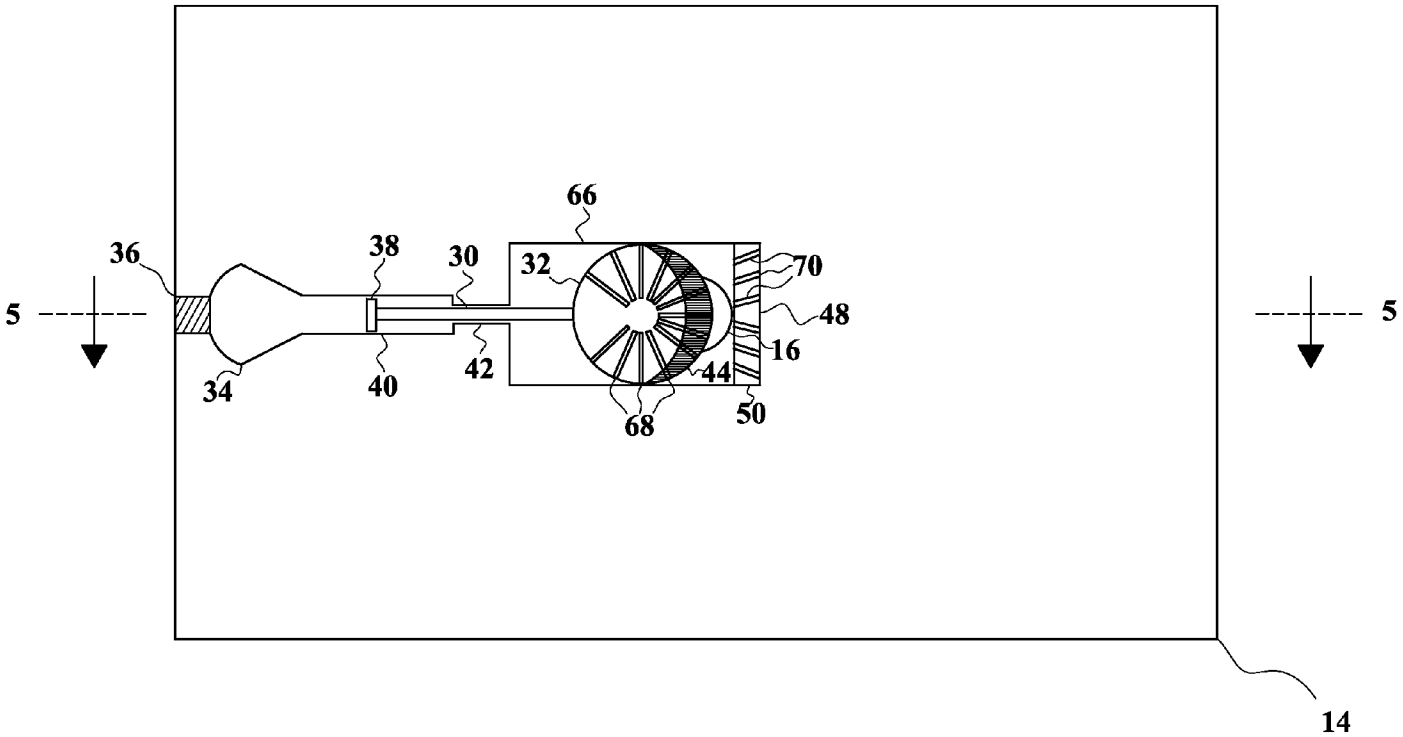
FIG. 9 is a horizontal sectional detail view, along lines 9-9 in FIG. 5, of a block having one plate in the preferred embodiment of the invention, showing the plate covering two-thirds of the channel.
Figure 10:
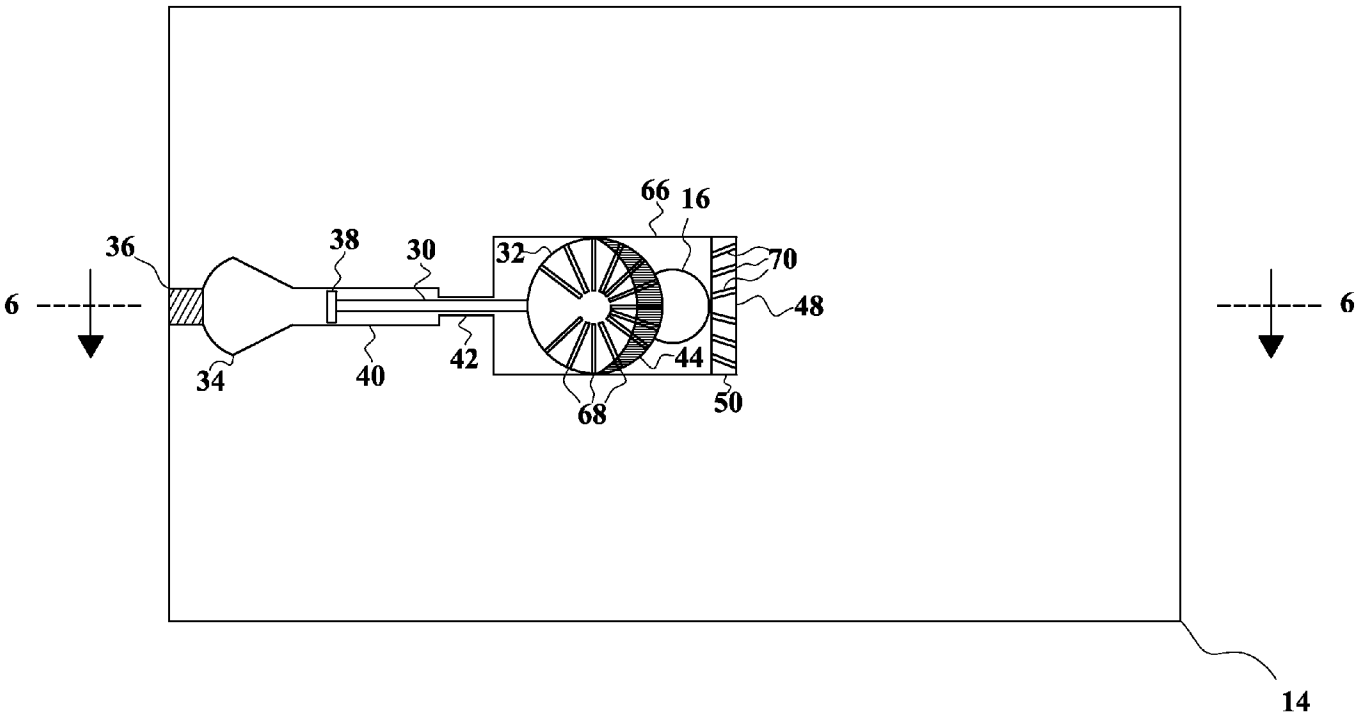
FIG. 10 is a horizontal sectional detail view, along lines 10-10 in FIG. 6, of a block having one plate in the preferred embodiment of the invention, showing the plate covering one-third of the channel.

FIG. 8 is a horizontal sectional detail view, along lines 8-8 in FIG. 4, of a block having one plate in the preferred embodiment of the invention, showing the position of the plate after the explosive charge for the piston has been fired. FIG. 9 is a horizontal sectional detail view, along lines 9-9 in FIG. 5, of a block having one plate in the preferred embodiment of the invention, showing the position of the plate after it has been retracted to cover two-thirds of the channel. FIG. 10 is a horizontal sectional detail view, along lines 10-10 in FIG. 6, of a block having one plate in the preferred embodiment of the invention, showing the position of the plate after it has been retracted to cover one-third of the channel.

Which plates have been activated may be indicated by displayed numbers, colors or indentations. The invention may be monitored visually on site or remotely by television, radio, wired connections, or any other suitable means. The movement of the gears and pistons may be measured and calibrated. The plates and pistons may be made of metal, high impact plastic or glass, or any other suitable material.

Figure 11:
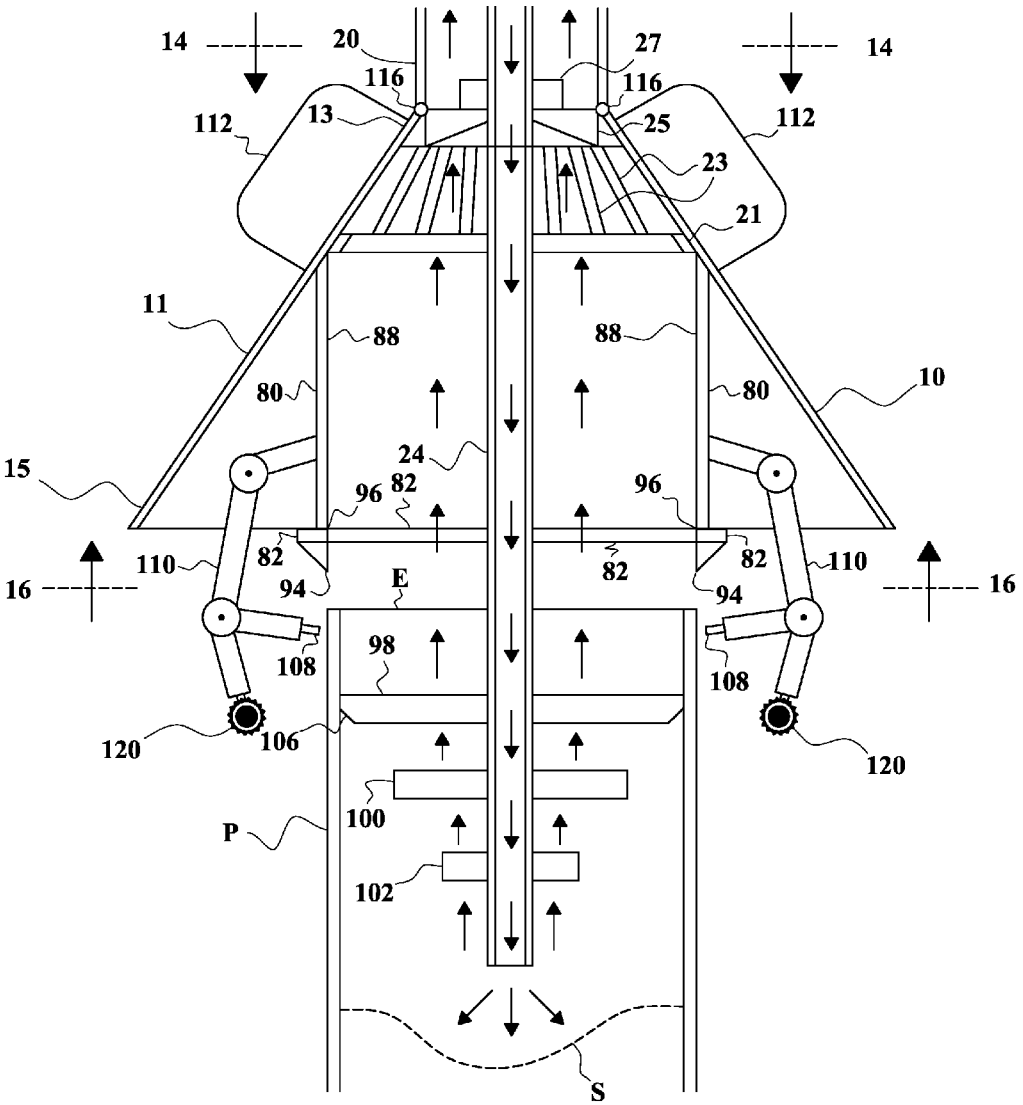
FIG. 11 is a vertical sectional detail view, along lines 11-11 in FIG. 14, of the lower portion of the preferred embodiment of the invention, showing the funnel in a lowered position.
Figure 14:
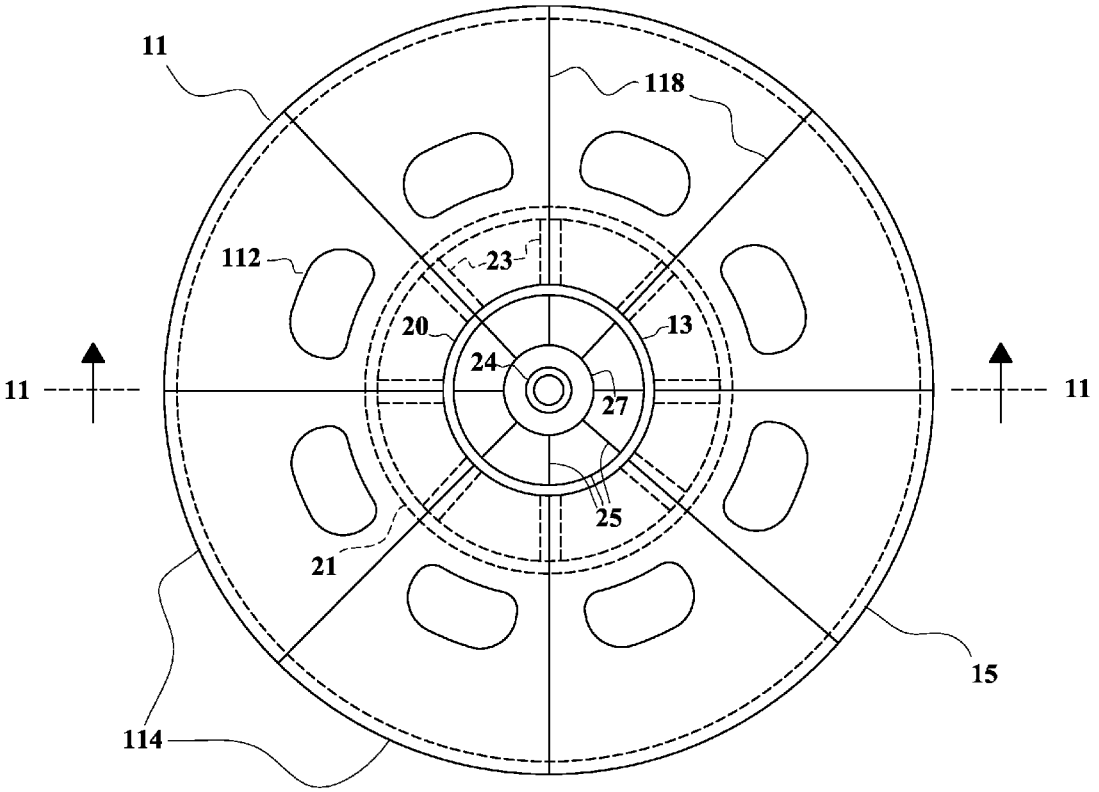
FIG. 14 is a horizontal sectional detail view, along lines 14-14 in FIG. 11, of the lower portion of the preferred embodiment of the invention, showing the funnel in a lowered position.

FIG. 11 is a vertical sectional detail view, along lines 11-11 in FIG. 14, of the lower portion of the preferred embodiment of the invention, showing the funnel in a lowered position. A sleeve 80 is suitably dimensioned and configured to be placed over a portion of the well pipe P adjacent to the open end E of the well pipe, with the sleeve being connected to the return pipe 20. The sleeve is shown above the well pipe, before it is placed over it, and before the funnel 11 is sucked down onto the well pipe P from which a first fluid (such as petroleum) is escaping. The funnel has a hollow frustoconical shape, and has a smaller end 13 and a larger end 15 that is suitably dimensioned and configured to be placed over the well pipe. The lower return pipe 20 is connected to the smaller end of the funnel. The high pressure pipe 24 passes through the return pipe and the funnel, and is suitably dimensioned and configured to be inserted into the well pipe P. A second fluid (such as air) is pumped through the high pressure pipe at a pressure greater than that of the first fluid, causing the first fluid to be separated by the second fluid in a space S adjacent to an end of the high pressure pipe that has been inserted into the pipe through which the first fluid is escaping. A portion of the first fluid that is not held back by the greater pressure of the second fluid will flow through the valve and the return pipe at an accelerated velocity, but at a reduced pressure due to the Bernoulli effect, thus helping to suck the valve down onto the well pipe P.

Figure 12:
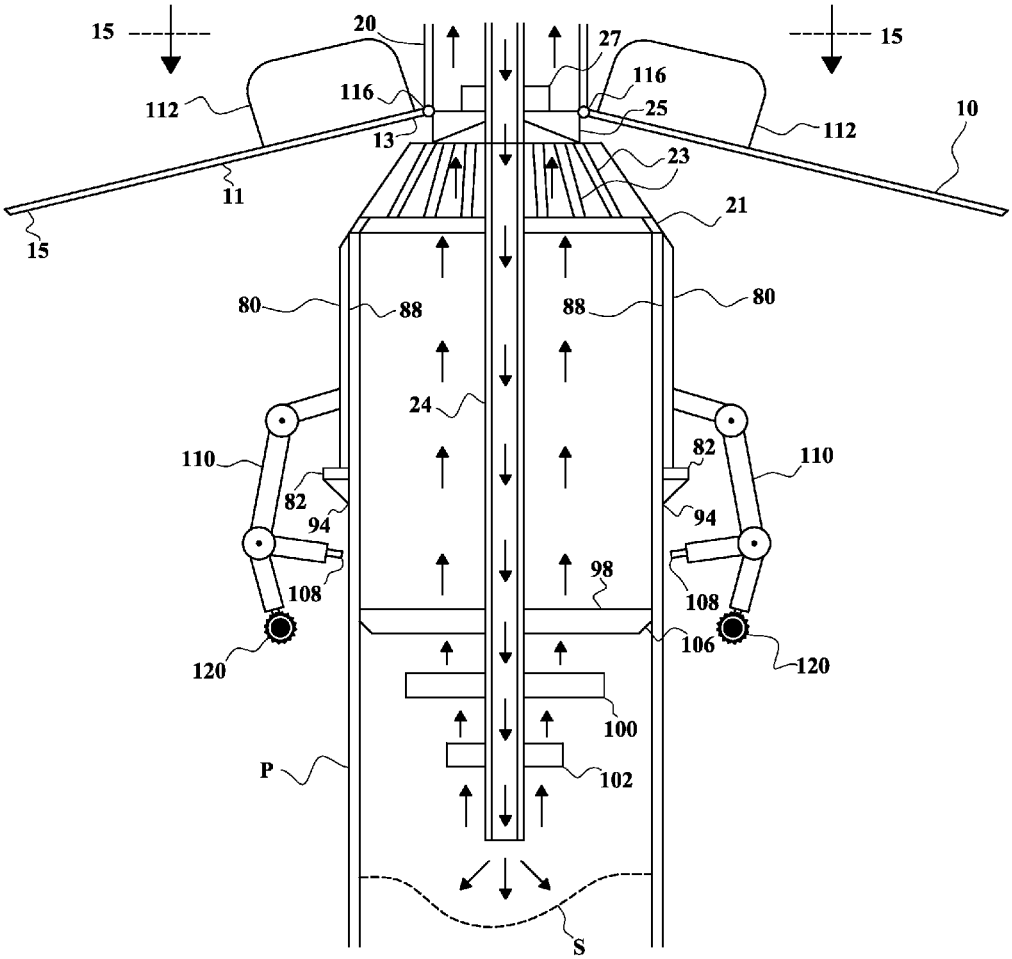
FIG. 12 is a vertical sectional detail of the lower portion of the preferred embodiment of the invention, showing the funnel in a raised position.
Figure 13:
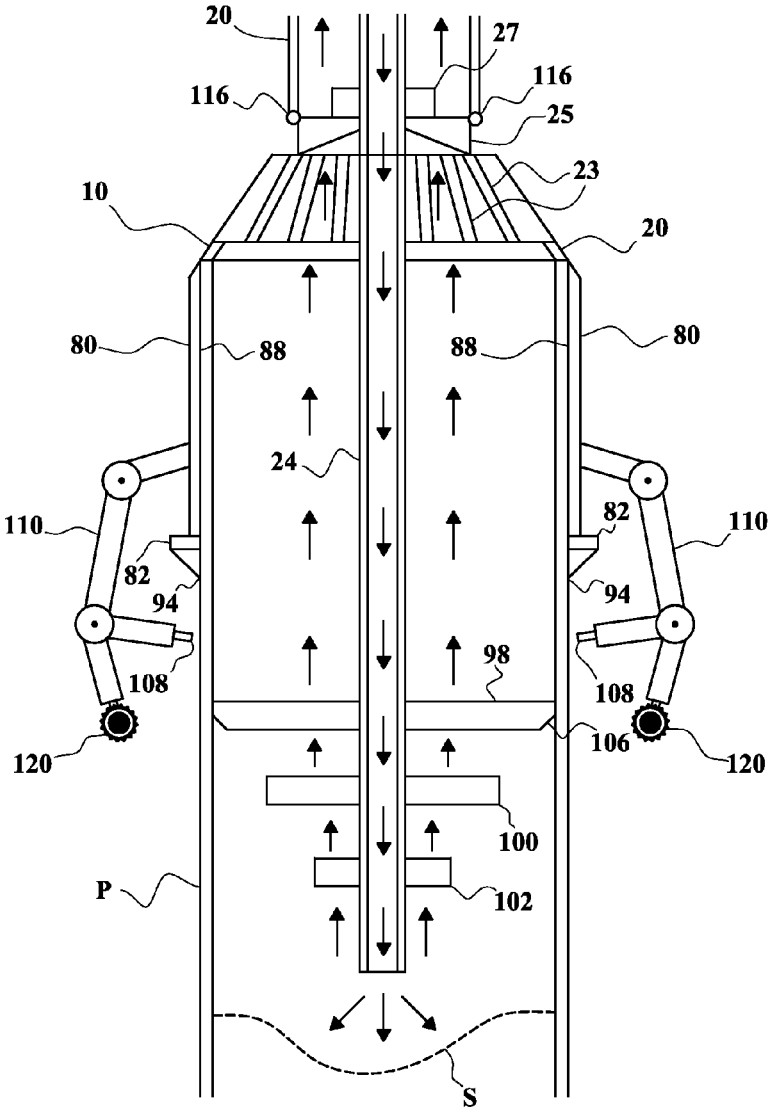
FIG. 13 is a vertical sectional detail of the lower portion of the preferred embodiment of the invention, with the funnel having been removed.

FIG. 12 is a vertical sectional detail of the lower portion of the preferred embodiment of the invention, showing the funnel 11 in a raised position, and the sleeve surrounding the top portion of the well pipe, after the valve is sucked down onto the well pipe P from which the first fluid was escaping. A first gasket 21 within the valve prevents the first and second fluids from leaking out between the valve and the well pipe P. Inside the valve, adjacent to its smaller end, there are channels 23 to further accelerate the flow of the first and second fluids toward the return pipe. (The channels may be small pipes.) Adjacent to the smaller end of the valve there is a turbine comprising blades 25 driven by motor 27, that can rotate to further accelerate the flow of the first and second fluids through the return pipe. A portion of the first fluid (e.g., oil) that is not held back by the greater pressure of the second fluid (e.g., air) will flow through the sleeve and then the return pipe. The sleeve may have two or more telescoping segments, or it may be in one piece without moving parts. The sleeve may be made of a rigid material with a fixed diameter, or of a flexible material with a variable diameter. Preferably, the sleeve has an interior surface 88 that can grip an exterior surface of the well pipe. FIG. 13 is a vertical sectional detail of the lower portion of the preferred embodiment of the invention, with the funnel having been removed.

Grinding devices 120 attached to the extension arms 110 can remove cement or other material from the well pipe, so that the sleeve can fit over it. One or more cutting devices 108 are attached to the extension arms, that can cut the well pipe. Preferably, the extension arms are moveable, and the grinding and cutting devices can rotate around the well pipe. The cutting devices may be lasers, electric saws, pneumatic or hydraulic cutters, or any other suitable means for neatly cutting the well pipe, so that bent or ruptured portions of the well pipe can be removed, to allow the invention to be attached to an intact portion of the well pipe. Preferably, a sharp edge 94 extends from a lower rim 96 of the sleeve, by which irregularities in the well pipe can be cut.

Figure 15:
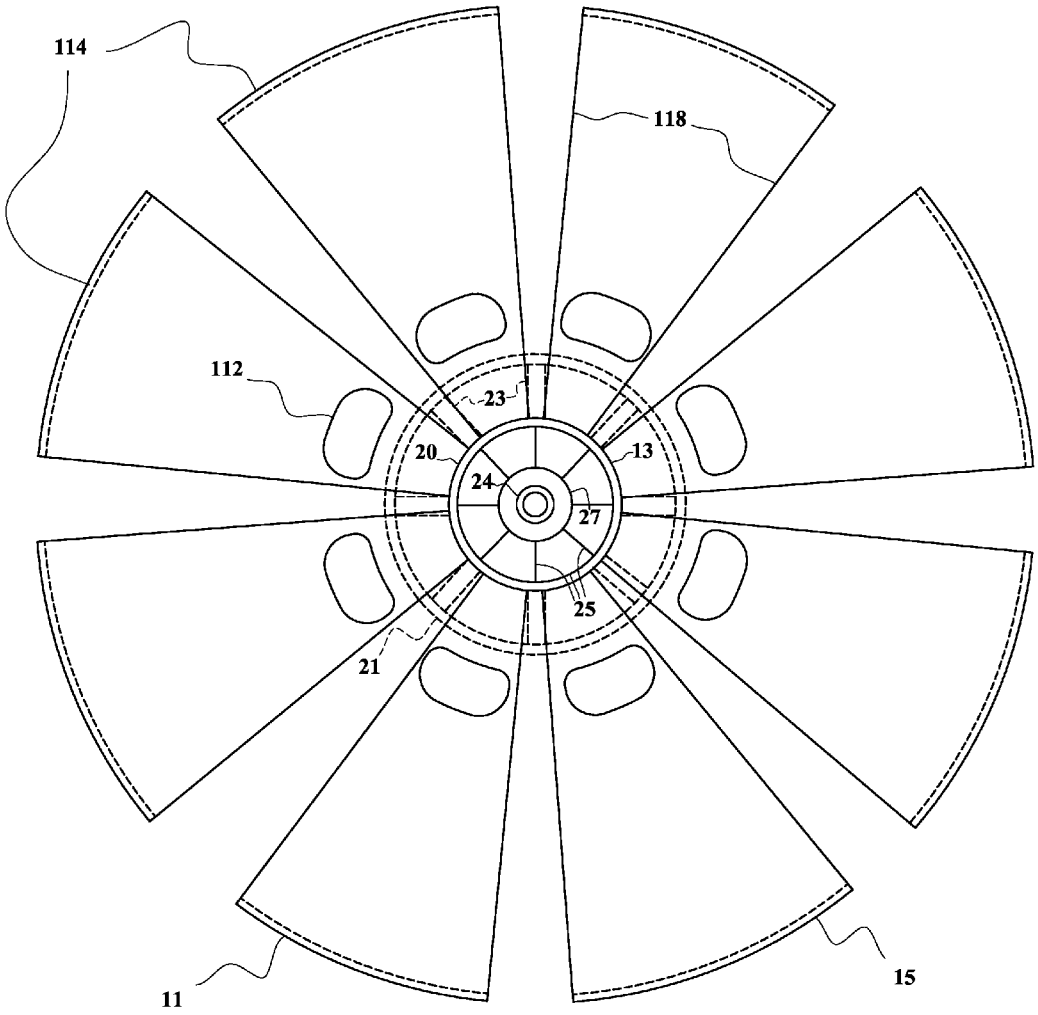
FIG. 15 is a horizontal sectional detail view, along lines 15-15 in FIG. 12, of the lower portion of the preferred embodiment of the invention, showing the funnel in a raised position.

FIG. 14 is a horizontal sectional detail view, along lines 14-14 in FIG. 11, of the lower portion of the preferred embodiment of the invention, showing the funnel in a lowered position. FIG. 15 is a horizontal sectional detail view, along lines 15-15 in FIG. 12, of the lower portion of the preferred embodiment of the invention, showing the funnel in a raised position.

The slope between the smaller end 13 and the larger end 15 of the funnel 11 can be adjusted. The funnel is shown in a lowered position in FIGS. 11 and 14, and in a raised position in FIGS. 12 and 15. (The possible positions of the funnel are not limited to the two positions shown.) The funnel is comprised of leaves (114 in FIGS. 14 and 15) that are pivotally connected by joints (116 in FIGS. 11 and 12) to the return pipe 16. The seams 118 are closed when the funnel is in a lowered position (as in FIG. 14) and separated when the funnel is in a raised position (as in FIG. 15). The funnel can be removed and raised to the surface of a body of liquid with the aid of floats 112 attached to the funnel. The leaves may be released from the joints by mechanical means, by an explosive charge, or by any other suitable means. The funnel can be reused after it is separated. The floats may be permanently buoyant, or inflated when needed.

Figure 16:
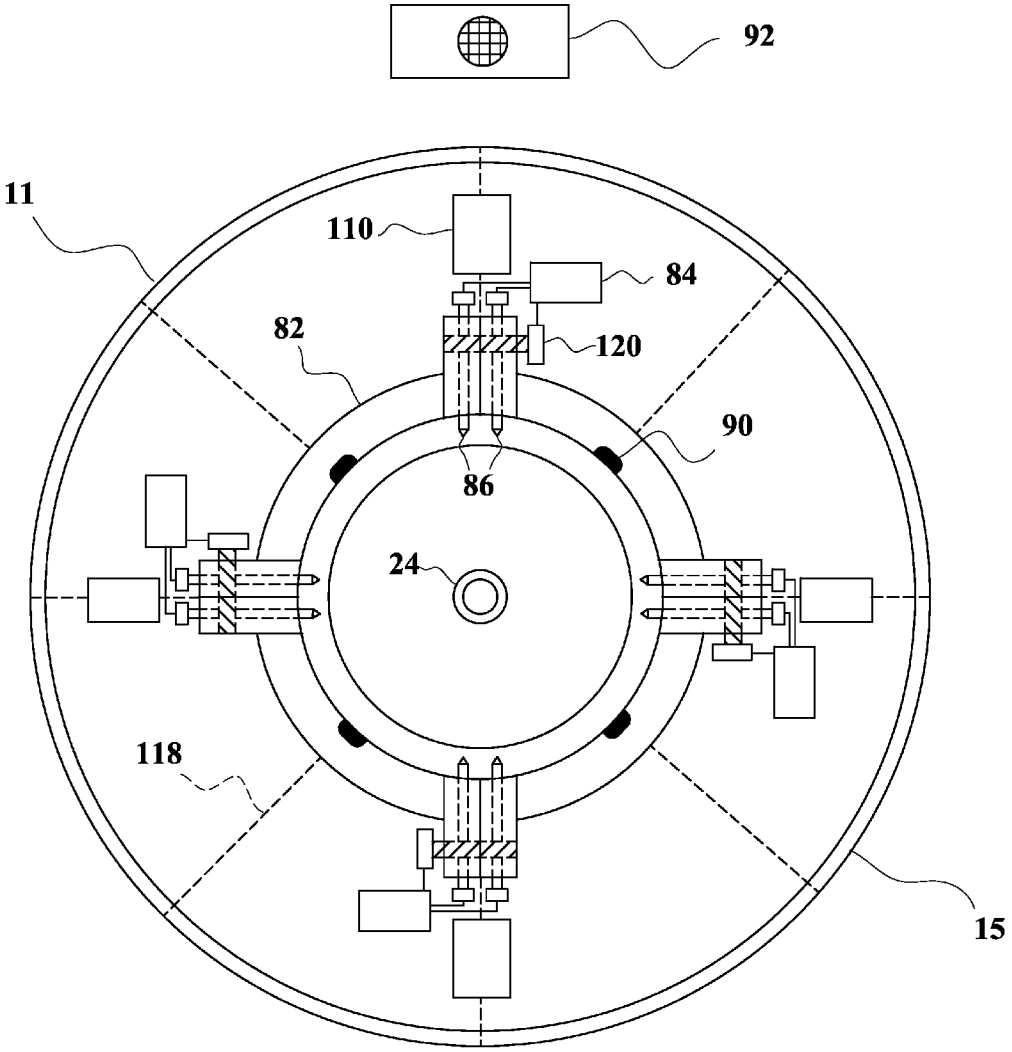
FIG. 16 is a horizontal sectional detail view, along lines 16-16 in FIG. 11, of the lower portion of the preferred embodiment of the invention.

FIG. 16 is a horizontal sectional detail view, along lines 16-16 in FIG. 11, of the lower portion of the preferred embodiment of the invention. A locking collar 82, attached to the sleeve, can lock the sleeve around the portion of the well pipe adjacent to the open end of the well pipe. A power source 84 for locking the locking collar using bolts 120 can apply sufficient force to pierce the well pipe and lock the locking collar onto the well pipe using attachment members 86, without causing the well pipe to collapse. Preferably, the sleeve and the locking collar are generally cylindrical. The attachment members preferably are evenly spaced around the locking collar. Preferably, there are one or more pressure sensors 90 and an alerting system 92 that is activated when the pressure sensors detect excessive pressure of the sleeve against the well pipe, to prevent the well pipe from being collapsed.

The connection between the sensors and the alerting system may be wired or wireless. Alerts may be audible, visible, etc.

Figure 17:
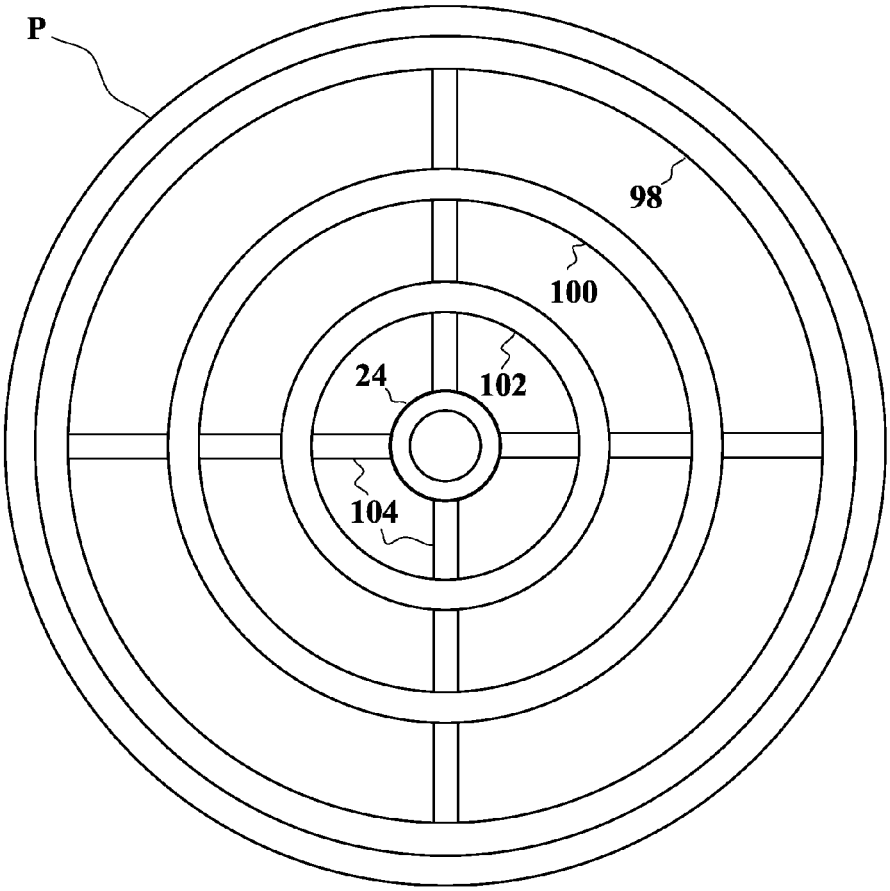
FIG. 17 is a top detail view of the well pipe with the cylindrical positioning rings inserted, in the preferred embodiment of the invention.
Figure 18:
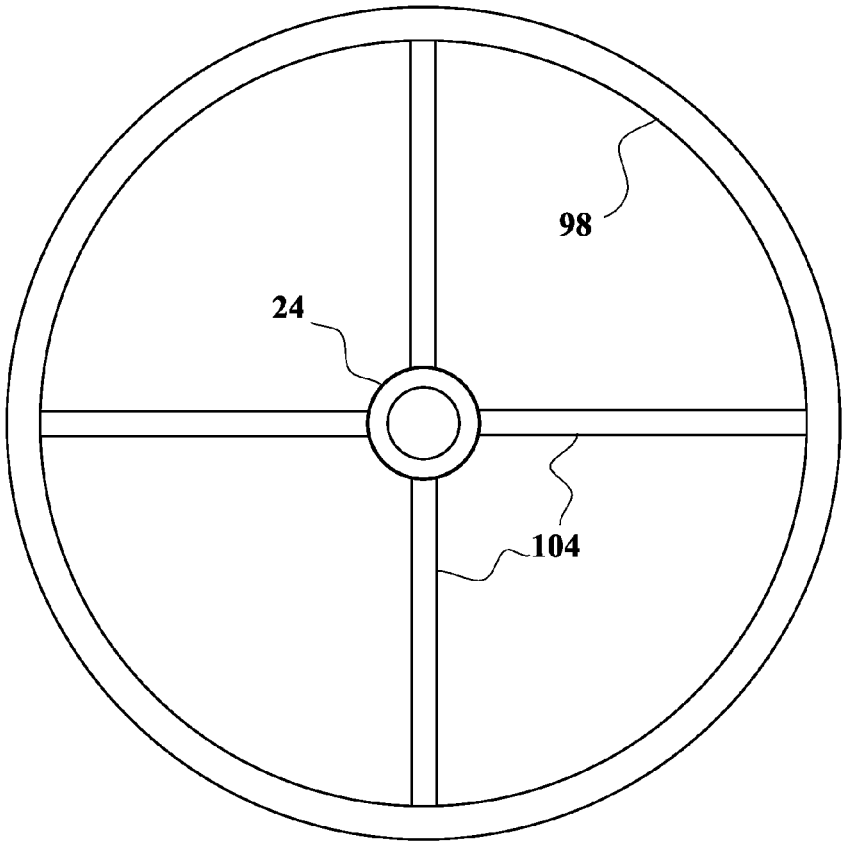
FIG. 18 is a top detail view of the largest positioning ring, in the preferred embodiment of the invention.
Figure 19:
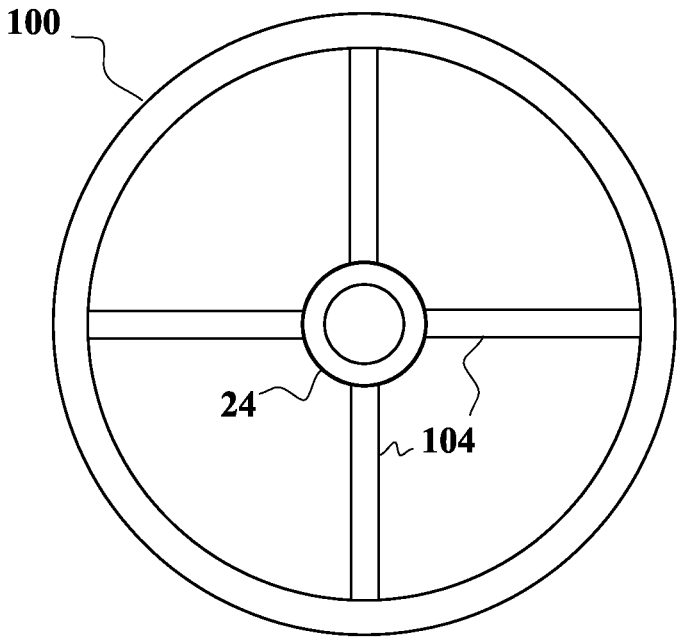
FIG. 19 is a top detail view of the middle positioning ring, in the preferred embodiment of the invention.
Figure 20:
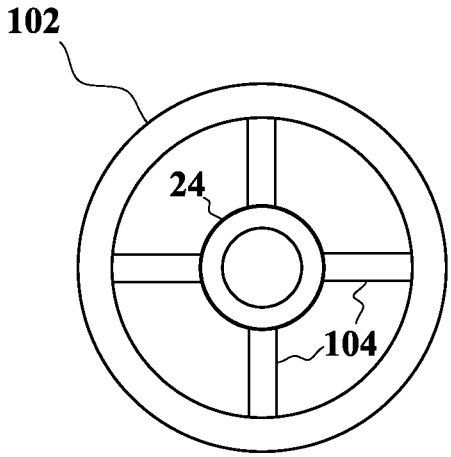
FIG. 20 is a top detail view of the smallest positioning ring, in the preferred embodiment of the invention.

One or more positioning rings (98, 100 and 102 in FIGS. 11-13) are attached to the high pressure pipe 24, that can fit inside the well pipe P. Preferably, there are a plurality of the positioning rings, that are attached by arms (104 in FIGS. 17-20) to the high pressure pipe, with the diameters of the rings increasing with their distance from an open end of the high pressure pipe. Preferably, the positioning rings are generally cylindrical. The positioning ring 98 at the greatest distance from the open end of the high pressure pipe has a beveled lower rim (106 in FIGS. 11-13). This ring preferably has an outside diameter at or just under the inside diameter of the well pipe. The main purpose of the positioning rings is to make it easier to correctly position the funnel and sleeve over the well pipe, but they can also contribute to the Bernoulli effect. FIG. 17 is a top detail view of the well pipe P with the cylindrical positioning rings inserted, in the preferred embodiment of the invention. FIG. 18 is a top detail view of the largest positioning ring 98, in the preferred embodiment of the invention. FIG. 19 is a top detail view of the middle positioning ring 100, in the preferred embodiment of the invention. FIG. 20 is a top detail view of the smallest positioning ring 102, in the preferred embodiment of the invention. (There may be a different number of positioning rings from what is shown in the drawings.)

The present invention also comprises a method of preventing and recovering from blowouts, comprising the steps of:

placing a larger end of a valve adjacent to an open end of a well pipe through which a first fluid is escaping, the valve having a smaller end that is connected to a return pipe;

moving the valve into alignment with the well pipe;

fastening a sleeve over a portion of the well pipe adjacent to the open end of the well pipe, said sleeve being connected to the return pipe;

inserting a high pressure pipe into the well pipe;

pumping the second fluid, at a higher pressure than that of the first fluid, through the high pressure pipe into the well pipe;

separating the first fluid by the second fluid in a space adjacent to an end of the high pressure pipe that has been inserted into the well pipe;

accelerating a portion of the first fluid that is not held back by the greater pressure of the second fluid, causing it to flow through the sleeve and the return pipe at an increased velocity, but at a reduced pressure due to the Bernoulli effect, thus supplying suction that helps to move the valve down onto the well pipe;

placing one or more blocks around portions of the return pipe, with each block having a channel that surrounds the pipe, and with each block having one or more plates that are initially to one side of the channel, one or more pistons attached to each plate, and an explosive charge for each piston, that when fired, can propel the plate to which the piston is attached across the channel to reduce the flow of the fluid;

retaining the blocks on the pipe; and firing one or more of the explosive charges, causing one or more of the pistons to move through a passage in the blocks for each of the pistons.

The invention may comprise further steps of:

grinding cement and irregularities in the well pipe, using one or more grinding devices, so that the sleeve can be placed over its open end;

moving the valve into alignment with the well pipe, with the aid of one or more positioning rings attached to the high pressure pipe, that can fit inside the well pipe;

locking the sleeve around the well pipe, using a locking collar attached to the sleeve; and moving the plates into or out from the channel, using gears having teeth that can engage teeth on the pistons;

It is to be understood that the present invention is not limited to the embodiment described above, but encompasses any and all embodiments within the scope of the following claims.

I claim:

1. A blowout preventer and recovery device, comprising:

a valve having a smaller end and a larger end, with the larger end being suitably dimensioned and configured to be placed over an open end of a well pipe through which a first fluid is escaping;

a return pipe connected to the smaller end of the valve;

a sleeve, suitably dimensioned and configured to be placed over a portion of the well pipe adjacent to the open end of the well pipe, with the sleeve being connected to the return pipe;

a high pressure pipe passing through the valve, suitably dimensioned and configured to be insertable into the well pipe;

one or more blocks, with each of the blocks having a channel, with the channel having at least one end that is dimensioned and configured so that the block is able to be inserted over a portion of the return pipe;

one or more plates in each of the blocks, initially to one side of the channel;

one or more pistons attached to each of the plates; and an explosive charge for each of the pistons, that is able to be fired and propel the plate into the channel to reduce the flow of the fluid;

wherein, a second fluid is pumped through the high pressure pipe at a pressure greater than that of the first fluid, the first fluid will be separated by the second fluid in a space adjacent to an end of the high pressure pipe that has been inserted into the well pipe, and a portion of the first fluid that is not held back by the greater pressure of the second fluid will flow through the sleeve and the return pipe at an accelerated velocity, but at a reduced pressure due to the Bernoulli effect, thus supplying suction to help move the valve down onto the well pipe.

2. The blowout preventer and recovery device according to claim 1, further comprising:

a passage in the blocks for each of the pistons, the passage having a narrow portion adjacent to the channel and a wide portion away from the channel; and a flange on each piston on an end of the piston opposite the plate to which the piston is attached, that prevents said end of the piston from moving into the narrow portion of the passage, thus limiting the movement of the plate to which the piston is attached.

3. The blowout preventer and recovery device according to claim 1, further comprising:

gears having teeth that are able to engage teeth on the pistons to move the plates out from the channel.

4. The blowout preventer and recovery device according to claim 1, further comprising:

a locking collar, attached to the sleeve, that is able to lock the sleeve around the portion of the well pipe adjacent to the open end of the well pipe; and a power source for locking the locking collar;

wherein said power source is able to apply sufficient force to pierce the well pipe and lock the locking collar onto the well pipe, without causing the well pipe to collapse;

wherein the sleeve and the locking collar are generally cylindrical; and wherein attachment members are evenly spaced around the locking collar, that are able to pierce the well pipe and lock the locking collar onto the well pipe.

5. The blowout preventer and recovery device according to claim 1, wherein:

the sleeve has an interior surface that is able to grip an exterior surface of the well pipe.

6. The blowout preventer and recovery device according to claim 1, further comprising:

one or more pressure sensors; and an alerting system that is activated when the pressure sensors detect excessive pressure of the sleeve against the well pipe.

7. The blowout preventer and recovery device according to claim 1, further comprising:

generally cylindrical positioning rings, that are attached by arms to the high pressure pipe, and are able to fit inside the well pipe, with the diameters of the rings increasing with the ring's distance from the open end of the high pressure pipe, and with the positioning ring at the greatest distance from the open end of the high pressure pipe has a beveled lower rim;

wherein the positioning rings contribute to the Bernoulli effect.

8. The blowout preventer and recovery device according to claim 1, wherein:

a sharp edge extends from a lower rim of the sleeve, by which irregularities in the well pipe are able to be cut.

9. The blowout preventer and recovery device according to claim 1, further comprising:

one or more cutting devices attached to one or more movable extension arms, that are able to cut the well pipe, and are able to rotate around the well pipe.

10. The blowout preventer and recovery device according to claim 1, further comprising:

one or more grinding devices, that are able to remove cement and irregularities from the well pipe, so that the sleeve is able to be placed over its open end.

11. The blowout preventer and recovery device according to claim 1, wherein:

a slope between the smaller end and the larger end of the valve is adjustable; and the valve is able to be removed and raised to the surface of a body of liquid with the aid of floats attached to the valve.

12. A blowout preventer and recovery device, comprising:

a valve having a smaller end and a larger end, with the larger end being dimensioned and configured to be placed over an open end of a well pipe through which a first fluid is escaping;

a return pipe connected to the smaller end of the valve;

a high pressure pipe passing through the valve, suitably dimensioned and configured to be insertable into the pipe through which the first fluid is escaping; and one or more positioning rings attached to the high pressure pipe, that are able to fit inside the well pipe;

wherein, a second fluid is pumped through the high pressure pipe at a pressure greater than that of the first fluid, the first fluid will be separated by the second fluid in a space adjacent to an end of the high pressure pipe that has been inserted into the well pipe, and a portion of the first fluid that is not held back by the greater pressure of the second fluid will flow through the valve and the return pipe at an accelerated velocity, but at a reduced pressure due to the Bernoulli effect, thus supplying suction that helps to move the valve down onto the well pipe; and one or more blocks, with each of the blocks having a channel, with the channel having at least one end that is dimensioned and configured so that the block is able to be inserted over a portion of the return pipe;

one or more plates in each of the blocks, initially to one side of the channel;

one or more pistons attached to each of the plates; and an explosive charge for each of the pistons, that is able to be fired and propel the plate into the channel to reduce the flow of the fluid.

13. The blowout preventer and recovery device according to claim 12, further comprising:

a passage in the blocks for each of the pistons, the passage having a narrow portion adjacent to the channel and a wide portion away from the channel; and a flange on each piston on an end of the piston opposite the plate to which the piston is attached, that prevents said end of the piston from moving into the narrow portion of the passage, thus limiting the movement of the plate to which the piston is attached.

14. The blowout preventer and recovery device according to claim 12, further comprising:

gears having teeth that are able to engage teeth on the pistons to move the plates into or out from the channel.

15. The blowout preventer and recovery device according to claim 12, wherein:

the positioning rings are generally cylindrical;

the positioning rings are attached by arms to the high pressure pipe;

the positioning rings are able to fit inside the well pipe;

the diameters of the positioning rings increases with their distance from the open end of the high pressure pipe;

the positioning ring at the greatest distance from the open end of the high pressure pipe has a beveled lower rim; and the positioning rings contribute to the Bernoulli effect.

16. The blowout preventer and recovery device according to claim 12, further comprising:

one or more grinding devices, that are able to remove cement and irregularities from the well pipe, so that the valve is able to be placed over the well pipe's open end.

17. A method of preventing and recovering from blowouts, comprising the steps of:

placing a larger end of a valve adjacent to an open end of a well pipe through which a first fluid is escaping, the valve having a smaller end that is connected to a return pipe;

moving the valve into alignment with the well pipe;

fastening a sleeve over a portion of the well pipe adjacent to the open end of the well pipe, said sleeve being connected to the return pipe;

inserting a high pressure pipe into the well pipe;

pumping a second fluid, at a higher pressure than that of the first fluid, through the high pressure pipe into the well pipe;

separating the first fluid by the second fluid in a space adjacent to an end of the high pressure pipe that has been inserted into the well pipe;

accelerating a portion of the first fluid that is not held back by the greater pressure of the second fluid, causing the first fluid to flow through the sleeve and the return pipe at an increased velocity, but at a reduced pressure due to the Bernoulli effect, thus supplying suction that helps to move the valve down onto the well pipe;

placing one or more blocks around portions of the return pipe, with each block having a channel that surrounds the pipe, and with each block having one or more plates that are initially to one side of the channel, one or more pistons attached to each plate, and an explosive charge for each piston, that is able to be fired and propel the plate to which the piston is attached across the channel to reduce the flow of the fluid;

retaining the blocks on the pipe; and firing one or more of the explosive charges, causing one or more of the pistons to move through a passage in the blocks for each of the pistons.

18. The method of preventing and recovering from blowouts according to claim 17, comprising the further step of:

moving the plates into or out from the channel, using gears having teeth that are able to engage teeth on the pistons.

19. The method of preventing and recovering from blowouts according to claim 17, comprising the further steps of:

grinding cement and irregularities in the well pipe, using one or more grinding devices, so that the sleeve is able to be placed over the well pipe's open end; and locking the sleeve around the well pipe, using a locking collar attached to the sleeve.

20. The method of preventing and recovering from blowouts according to claim 17, wherein:

the valve is moved into alignment with the well pipe, with the aid of one or more positioning rings attached to the high pressure pipe, that are able to fit inside the well pipe.

* * * * *